US010697098B2

(12) United States Patent
Tanaka

(10) Patent No.: US 10,697,098 B2
(45) Date of Patent: Jun. 30, 2020

(54) COATING APPARATUS OF AIRBAG REINFORCING LIQUID

(71) Applicant: TOYODA GOSEI CO., LTD., Kiyosu-shi, Aichi-ken (JP)

(72) Inventor: Koki Tanaka, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 86 days.

(21) Appl. No.: 15/907,652

(22) Filed: Feb. 28, 2018

(65) Prior Publication Data

US 2018/0274145 A1 Sep. 27, 2018

(30) Foreign Application Priority Data

Mar. 23, 2017 (JP) ..... 2017-057928

(51) Int. Cl.
*D05B 29/12* (2006.01)
*B05C 11/02* (2006.01)
(Continued)

(52) U.S. Cl.
CPC ..... *D05B 29/12* (2013.01); *B05C 5/02* (2013.01); *B05C 11/023* (2013.01); *D05B 81/00* (2013.01);
(Continued)

(58) Field of Classification Search
CPC ..... D05B 17/00; D05B 71/00; D05B 1/26; D05B 29/12; D05B 81/00; D06B 1/00;
(Continued)

(56) References Cited

U.S. PATENT DOCUMENTS 2,480,882 A * 9/1949 Schmidt ..... B29C 65/18 156/554
2,664,938 A * 1/1954 Torr ..... B29C 65/4895 156/367
(Continued)

FOREIGN PATENT DOCUMENTS

EP 2216165 A1 8/2010
JP S58-195586 A 11/1983
(Continued)

OTHER PUBLICATIONS

Office Action dated Mar. 3, 2020 issued in corresponding JP patent application No. 2017-057928 (and English translation).

*Primary Examiner* — Alissa L Hoey
*Assistant Examiner* — Patrick J. Lynch
(74) *Attorney, Agent, or Firm* — Posz Law Group, PLC

(57) ABSTRACT

A coating apparatus of an airbag reinforcing liquid is used in a sewing machine that includes: a sewing needle driving an upper thread by penetrating sewing target cloth through a vertical movement; and a presser foot disposed above the sewing target cloth, and feeding the sewing target cloth while moving vertically synchronously with the vertical movement of the sewing needle. The coating apparatus includes: a reinforcing liquid supplying part, supplying a reinforcing liquid for reinforcing a sewn part onto the sewing target cloth on a front side from the sewing needle in a feeding direction of the sewing target cloth; and a stamp part attached to the presser foot, and expand the reinforcing liquid supplied from the reinforcing liquid supplying part onto the sewing target cloth around the sewn part by being operated integrally with the presser foot above the sewing target cloth.

15 Claims, 3 Drawing Sheets

(51) Int. Cl.
*B05C 5/02* (2006.01)
*D05B 81/00* (2006.01)
*D06M 23/18* (2006.01)

(52) U.S. Cl.
CPC ..... *D06M 23/18* (2013.01); *D05D 2305/22* (2013.01); *D10B 2505/124* (2013.01)

(58) Field of Classification Search
CPC ..... D06B 1/02; B05C 5/02; B05C 11/023; B05C 5/00; D10B 2505/124
USPC ..... 112/217
See application file for complete search history.

(56) References Cited

U.S. PATENT DOCUMENTS 2,905,118 A * 9/1959 Quinn ..... D05B 1/06 112/34
4,261,272 A * 4/1981 Duescher ..... D05B 35/02 112/217
4,495,879 A * 1/1985 Yamamoto ..... D05B 81/00 112/217
2001/0046826 A1* 11/2001 Tebbe ..... D06B 1/00 442/294
2010/0199900 A1* 8/2010 Brunner ..... D05B 35/00 112/270
2016/0214562 A1* 7/2016 Kalandek ..... B60R 21/235
2016/0229371 A1 8/2016 Kalandek

FOREIGN PATENT DOCUMENTS

JP 07-266146 A 10/1995
JP 2004-060071 A 2/2004
JP 2007-297725 A 11/2007
JP 2010-180487 A 8/2010
JP 2010-185165 A 8/2010
JP 2016-533293 A 10/2016
WO WO-9600810 A1 * 1/1996 ..... D05B 1/26

* cited by examiner

COATING APPARATUS OF AIRBAG REINFORCING LIQUID

CROSS-REFERENCE TO RELATED APPLICATION(S)

This application is based upon and claims the benefit of priority from prior Japanese patent application No. 2017-057928, filed on Mar. 23, 2017, the entire contents of which are incorporated herein by reference.

BACKGROUND

The invention relates to a coating apparatus of an airbag reinforcing liquid which coats a sewn part of an airbag with a reinforcing liquid.

In an airbag formed by sewing a plurality of pieces of cloth, there is a concern that, when the airbag is spread and inflated by an inflation gas, the cloth is stretched, and an excessive load is applied to the sewn part, resulting in causing a misalignment. The misalignment indicates that an initial shape is collapsed which should be originally maintained due to mutual restraint of a warp and a weft in the cloth, and a weave pattern is misaligned to impair an appearance. Further, there is a concern that the misalignment is enlarged due to a high pressure inflation gas flowing through the seam of the sewn part with high temperature.

In this regard, the sewn part is reinforced. As a mode of the reinforcement, it is common to coal a surface of the cloth coming in touch with the inflation gas with silicone and the like, and to sew a ribbon-shaped (belt-shaped) reinforcing cloth over the cloth.

However, even in the mode of the reinforcement, the bulk of the airbag housed in a folded-up state is increased. In order to suppress the enlargement of the misalignment while suppressing the increase of the bulk, therefore, a technique has been considered in which only the sewn part and the peripheral portion are coated with a reinforcing liquid. For example, a sewing machine is disclosed in JP-A-2004-60071 in which a chuck, which can perform coating along the seam in conjunction with the movement of the sewing needle, is provided, and a chalk-shaped solid body for coating is fixed to the chuck (for example, see FIG. 6).

Incidentally, in the above-described technique in the related art, the chuck is moved separately from the sewing needle so that a dedicated mechanism which is in conjunction with the movement of the sewing needle is needed additionally. Thus, the coating apparatus becomes complicated, which is problematic.

SUMMARY

The invention has been made in consideration of the above situation, and it is an object of the invention to provide a coating apparatus of an airbag reinforcing liquid which can coat a sewn part and a peripheral portion with a reinforcing liquid with a simple configuration.

According to an aspect of the invention, there is provided a coating apparatus of an airbag reinforcing liquid, which is used in a sewing machine that includes: a sewing needle which is configured to drive an upper thread by penetrating sewing target cloth through a vertical movement, a plurality of pieces of airbag forming cloth vertically overlapped with each other being set as the sewing target cloth; and a presser foot which is disposed above the sewing target cloth, and which is configured to feed the sewing target cloth while moving vertically synchronously with the vertical movement of the sewing needle, the coating apparatus including: a reinforcing liquid supplying part which is configured to supply a reinforcing liquid for reinforcing a sewn part formed by the sewing needle onto the sewing target cloth on a front side from the sewing needle in a feeding direction of the sewing target cloth; and a stamp part which is attached to the presser foot, and which is configured to expand the reinforcing liquid supplied from the reinforcing liquid supplying part onto the sewing target cloth around the sewn part by being operated integrally with the presser foot above the sewing target cloth.

DETAILED DESCRIPTION OF EXEMPLARY EMBODIMENTS

Hereinafter, one embodiment of a coating apparatus of an airbag reinforcing liquid will be described with reference to the drawings.

Figure 1:
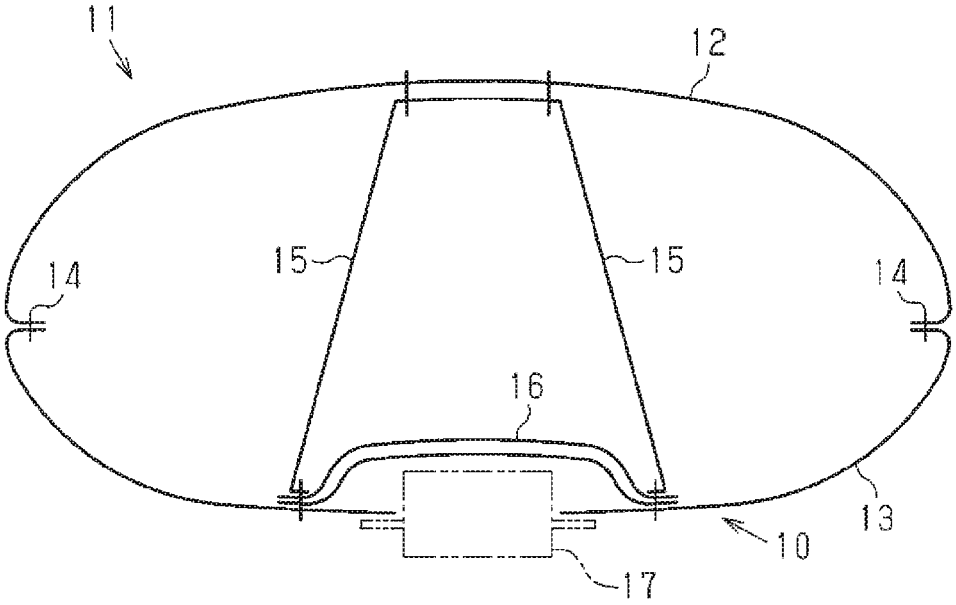
FIG. 1 is a sectional view illustrating a schematic configuration of an airbag device in one embodiment.

FIG. 1 illustrates a schematic configuration of a driver seat airbag device (hereinafter, simply referred to as "airbag device") 10 which is mounted in a steering wheel of the vehicle. The airbag device 10 includes an airbag 11 and an inflator 17 which supplies an inflation gas to the airbag 11.

The outer shell portion of the airbag 11 is formed of a pair of pieces of cloth 12 and 13. Woven cloth formed by a polyimide fiber, a polyester fiber, and the like is applied to both pieces of cloth 12 and 13. However, the pieces of cloth 12 and 13 may be formed by other fibers. In addition, the weaving mode of both pieces of cloth 12 and 13 is typically a plain weaving. But, additionally, twill weaving, satin weaving, or the like may be used for example.

Both pieces of cloth 12 and 13 are coupled to each other by the sewn part 14 provided in the circumferential edge thereof. Incidentally, a reference numeral 15 in FIG. 1 indicates a tether for arranging the shape of the airbag 11 properly in such a manner that the tether becomes in a tension state when the airbag 11 is spread and inflated so as to regulate the excessive inflation of the airbag 11. In addition, the reference numeral 16 indicates a rectifying cloth which rectifies the inflation gas injected from the inflator 17.

In the airbag device 10, when the impact is applied to a vehicle, the inflation gas is injected from the inflator 17, and the airbag 11 is spread and inflated from the steering wheel to the rear side of the vehicle, so as to restrain an occupant sitting on a driver seat. Thus, the impact applied to the occupant is alleviated.

Figure 2:
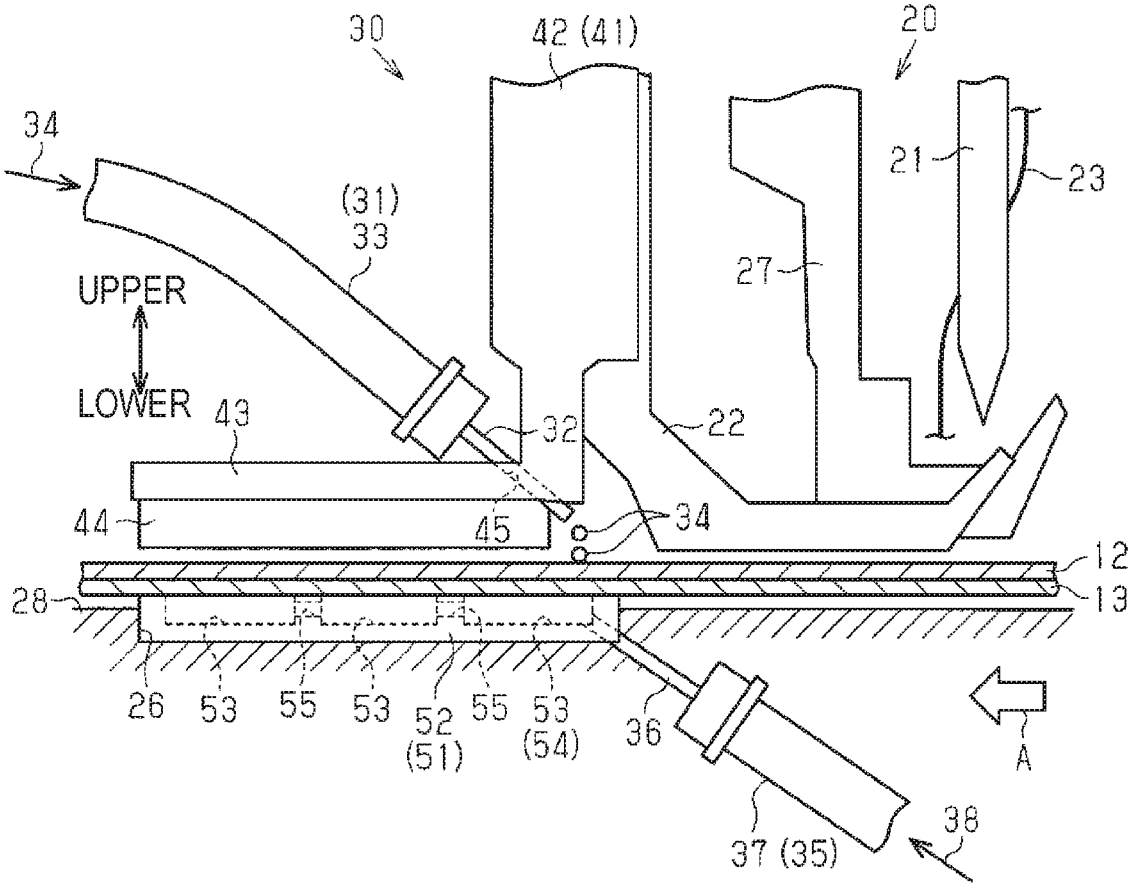
FIG. 2 is a sectional view partially illustrating a schematic configuration of a sewing machine and a coating apparatus in the embodiment.
Figure 3:
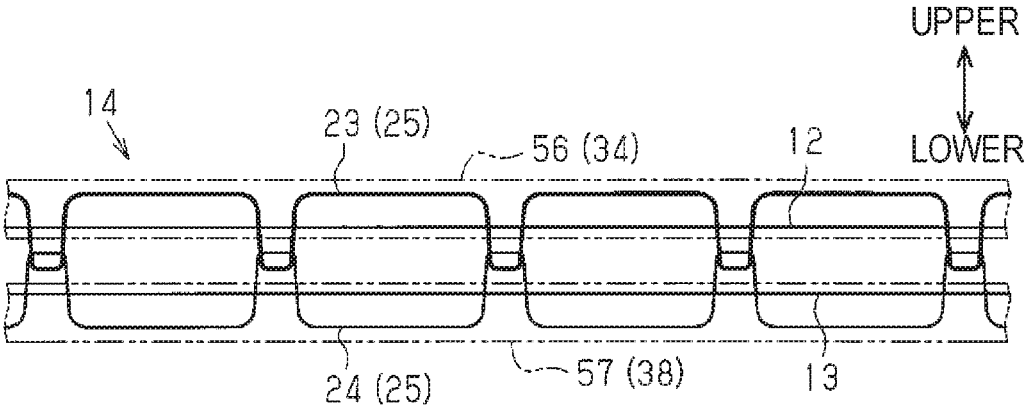
FIG. 3 is a schematic sectional view partially illustrating a sewn part of an airbag in the embodiment together with an upper reinforcement coating film and a lower reinforcement coating film.

In the above-described airbag device 10, the high load of the inflation gas is applied particularly to the sewn part 14 forming the outer shape of the airbag 11. As illustrated in FIG. 3, the sewn part 14 is reinforced by the upper reinforcement coating film 56 formed on the upper surface of the upper cloth 12 and the lower reinforcement coating film 57 formed on the lower surface of the lower cloth 13. As illustrated in FIG. 2, the coating apparatus 30 which performs coating with the upper reinforcing liquid 34 and the lower reinforcing liquid 38 is used in order to form the upper reinforcement coating film 56 and the lower reinforcement coating film 57. The coating apparatus 30 is attached in the sewing machine 20 which sews the airbag 11.

As illustrated in FIG. 2, the sewing machine 20 includes a bed part 28 on which the pieces of cloth 12 and 13 overlapped vertically are placed. The bed part 28 is partially formed of a needle plate (not illustrated). A mechanism which drives various movable portions of the sewing machine 20 is disposed under the bed part 28 in the sewing machine 20.

The sewing machine 20 further includes a sewing needle 21 and a presser foot 22. The sewing needle 21 is attached to the lower end of a needle bar (not illustrated) which is vertically driven reciprocatably by a motor and the like.

A shuttle (not illustrated) is disposed under the needle plate. The bobbin in which a lower thread 24 (see FIG. 3) is wound is housed in a bobbin case of the shuttle. The shuttle functions to allow the lower thread 24 drawn from the bobbin to pass through and be entangled in a loop which is formed in an upper thread 23 under both pieces of cloth 12 and 13 by a vertical movement of the sewing needle 21.

The presser foot 22 is disposed above the bed part 28. The sewing machine 20 includes a feed dog (not illustrated) which protrudes and retracts from an opening part of the needle plate in a reciprocative swinging manner. The presser foot 22 feeds the both pieces of cloth 12 and 13 at each of the sewing pitch in a direction indicated by arrow A in FIG. 2 in collaboration with the feed dog while moving vertically synchronously with the vertical movement of the sewing needle 21.

Incidentally, the reference numeral 27 in FIG. 2 indicates a cloth presser which supports the presser foot 22 to feed the pieces of cloth 12 and 13 by pressing the pieces of cloth 12 and 13 not to float when the both pieces of cloth 12 and 13 are sewn.

A thread made of the same fiber as the both pieces of cloth 12 and 13 is used as the upper thread 23 and the lower thread 24.

The coating apparatus 30 includes an upper reinforcing liquid supplying part 31 and a lower reinforcing liquid supplying part 35 as a reinforcing liquid supplying part. The upper reinforcing liquid supplying part 31 includes a hollow upper nozzle 32 forming a needle shape. The upper nozzle 32 is positioned on the front side (left side of FIG. 2) from the sewing needle 21 in a feeding direction of the both pieces of cloth 12 and 13, and is disposed above the bed part 28. The upper nozzle 32 is connected in a pump (not illustrated) through an upper tube 33.

The lower reinforcing liquid supplying part 35 includes a hollow lower nozzle 36 forming a needle shape. The lower nozzle 36 is disposed on the front side from the sewing needle 21 in the feeding direction of the both pieces of cloth 12 and 13. The lower nozzle 36 is connected in the pump (not illustrated) through a lower tube 37.

The coating apparatus 30 includes an upper stamp part 41 and a lower stamp part 51 as a stamp part. The upper stamp part 41 is positioned on the front side from the sewing needle 21 in the feeding direction of the both pieces of cloth 12 and 13, and is disposed above the bed part 28. The frame portion of the upper stamp part 41 includes a vertical wall 42 which extends vertically, and a horizontal wall 43 which extends from the lower end of the vertical wall 42 to the front side in the feeding direction. In the vertical wall 42, the upper stamp part 41 is attached to the presser foot 22 by a fastener such as a bolt and a nut. An upper elastic part 44 made of an elastic material such as rubber and an elastomer is disposed as a portion of the upper stamp part 41 below the horizontal wall 43, and is fixed in the horizontal wall 43 by a fixing unit such as an adhesive.

An attachment hole 45 which is tilted to become higher toward the front side in the feeding direction of the pieces of cloth 12 and 13 is formed in the boundary portion between the horizontal wall 43 and the vertical wall 42. The above-described upper nozzle 32 is attached to the upper stamp part 41 in the state of being inserted into the attachment hole 45. The lower end of the upper nozzle 32 is slightly exposed downward from the vertical wall 42 and the horizontal wall 43, and configures an exhaust port. Incidentally, the upper nozzle 32 may be attached to be positioned in a place where the exhaust port is overlapped with the lower end of the attachment hole 45 or a place in the attachment hole 45.

The lower stamp part 51 is positioned on the front side from the sewing needle 21 in the feeding direction of the both pieces of cloth 12 and 13, and is disposed below the both pieces of cloth 12 and 13. In this embodiment, in the bed part 28, the lower stamp part 51 is fitted and mounted in an attaching recess 26 formed under the upper stamp part 41. Similarly to the upper elastic part 44, the entire lower stamp part 51 includes a lower elastic part 52 made of an elastic material such as rubber and an elastomer. A storing part 54 which stores the lower reinforcing liquid 38 is formed in the lower elastic part 52. The storing part 54 includes a plurality of recesses 53 which are open in the upper surface of the lower elastic part 52, and a communicating hole 55 which communicates adjacent recesses 53. Further, the above-described lower nozzle 36 is inserted into the lower elastic part 52 to face the storing part 54, such that the exhaust port of the tip is positioned in the storing part 54. In this case, an aspect where the lower nozzle 36 is disposed is not limited particularly as long as a condition is satisfied which does not interfere with various mechanisms of the sewing machine 20. For example, the lower nozzle 36 may be disposed in the state of being tilted with respect to the feeding direction of the pieces of cloth 12 and 13, or may be disposed in the posture of extending in a horizontal direction. In any cases, the lower nozzle 36 is elongate to form the needle shape, and thus is easily disposed in the case of forming another shape.

Figure 4:
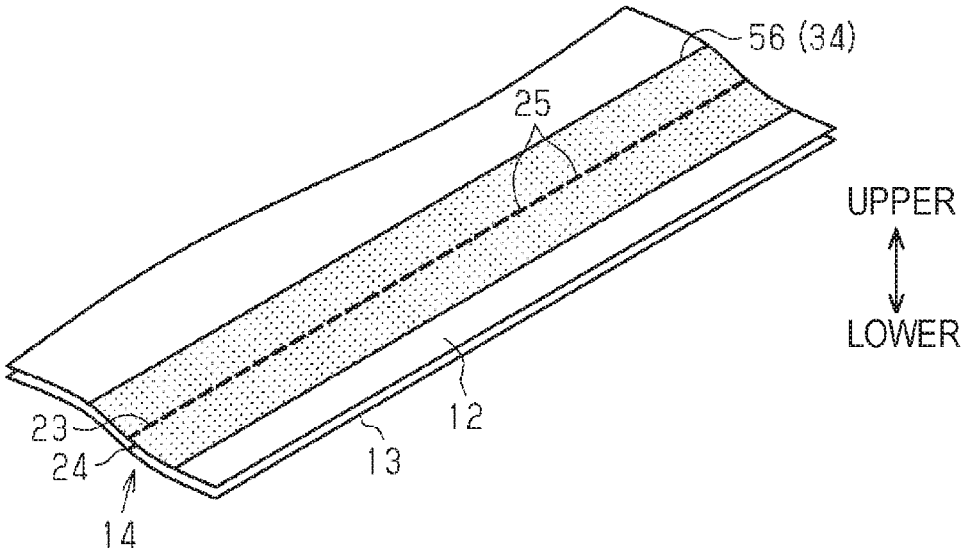
FIG. 4 is a perspective view partially illustrating a state where upper cloth of airbag in the embodiment is coated with an upper reinforcing liquid.
Figure 5:
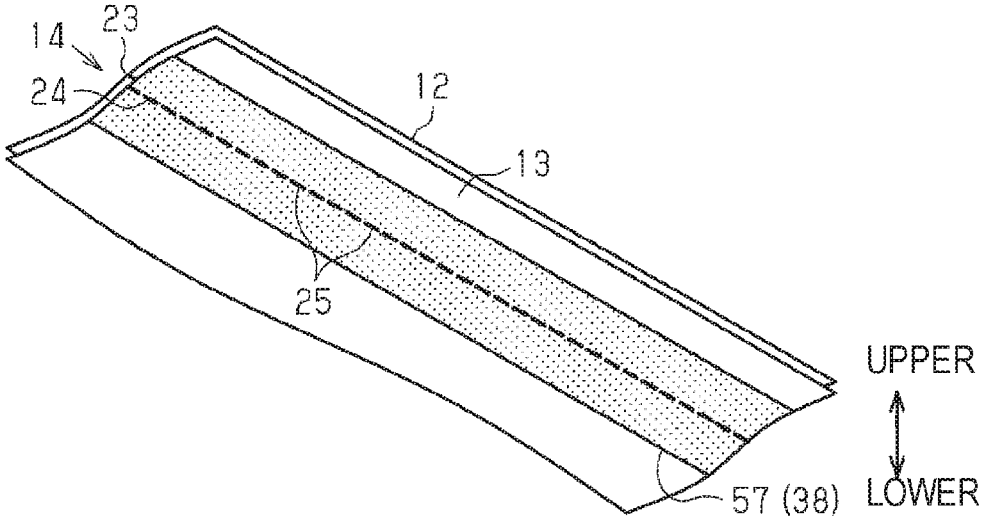
FIG. 5 is a perspective view partially illustrating a state where lower cloth of the airbag in the embodiment is coated with a lower reinforcing liquid.

Incidentally, as illustrated in FIGS. 3 to 5, the upper reinforcement coating film 56 which is formed in a belt shape of a predetermined width including the sewn part 14 with respect to the upper cloth 12 is used as the upper reinforcing liquid 34. In addition, the lower reinforcement coating film 57 which is formed in a belt shape of a predetermined width including the sewn part 14 with respect to the lower cloth 13 is used as the lower reinforcing liquid 38. More specifically, an adhesive paint which has adhesiveness wettability) with respect to the fiber configuring the upper thread 23, the lower thread 24, and the both pieces of cloth 12 and 13 is used as the upper reinforcing liquid 34 and the lower reinforcing liquid 38. In terms of handleability, an environmental problem, and the like, an emulsion without a solvent (in which another liquid in a liquid becomes particulate so as to be dispersed and floated) is desirably used as the adhesive paint.

As described above, a base resin in the adhesive paint is not particularly limited as long as the base resin has the adhesiveness (wettability) also with respect to any one of the both pieces of cloth 12 and 13, the upper thread 23, and the lower thread 24. However, in a case where the both pieces of cloth 12 and 13 are formed by the polyamide fiber or the polyester fiber, a resin (polymer) such as a polyamide resin, an ester resin, a urethane resin, and an epoxy resin is proper as the base resin.

Thereamong, in terms of coating film durability, it is desirable to use aqueous polyether modified urethane and carbonate modified urethane having hydrolysis resistance. In terms of slippage resistance increase effect, hydrolysis resistance, and further productivity, a carbonate modified urethane is desirable which has short curing time by adding a crosslinking agent. Herein, the carbonate modified urethane indicates polyurethane having a polycarbonate chain or subjective polyurethane. In addition to the polycarbonate chain, the carbonate modified urethane may have another functional group. However, in this case, the carbonate modified urethane desirably has hydrolysis resistance in terms of the coating film durability. In addition, typically, the modified urethane is used desirably in a state where a terminal COO— is blocked by amines such as triethylamine in terms of securing a pot life of the paint. In addition, the above-described crosslinking agent is not limited as long as the agent is condensation-reactive with COO—. For example, glycols, amino alcohols, and diamines which are oxazoline or in which both terminals are any one of hydroxyl group and amino group can be used as the crosslinking agent.

Incidentally, in the above-described adhesive paint, a defoaming agent, a thickener, and the like may be added appropriately in terms of coatability, or a secondary material such as a colorant may be appropriately added in terms of the appearance of the upper reinforcement coating film 56 and the lower reinforcement coating film 57.

Next, the description will be given about the operation and the effect of this embodiment described above.

As illustrated in FIG. 2, in a case where the airbag 11 is sewn by the sewing machine 20, the pieces of cloth 12 and 13 which are vertically overlapped with each other are placed as a sewing target cloth on the bed part 28. The sewing needle 21 penetrates the both pieces of cloth 12 and 13 during a downward movement, and the upper thread 23 is driven into the both pieces of cloth 12 and 13. The sewing needle 21 goes upward from the both pieces of cloth 12 and 13 during the upward movement. At that time, a frictional force between the upper thread 23 and the both pieces of cloth 12 and 13 is larger than a frictional force between the sewing needle 21 and the upper thread 23. For this reason, when the sewing needle 21 is switched from the downward movement to the upward movement, the upper thread 23 is loosed on the lower side from the needle plate so as to form a loop. At the same time, the shuttle which rotates in conjunction with the vertical movement of the sewing needle 21 scoops up the upper thread 23 formed in a loop with a point. Further, the shuttle rotates, and a thread take-up lever is elevated in a position where the point exceeds a predetermined position so as to make the shuttle pass through the loop of the upper thread 23. As illustrated in FIG. 3, the lower thread 24 which protrudes from the bobbin case is intertwined with the upper thread 23 so that the seam 25 is formed on each of the upper surface of the cloth 12 and the lower surface of the cloth 13. As illustrated in FIGS. 4 and 5, the seam 25 is continuously formed so that the sewn part 14 is formed which couples the circumferential edges of the both pieces of cloth 12 and 13 to each other.

As illustrated in FIG. 2, while moving vertically synchronously with the vertical movement of the sewing needle 21, the presser foot 22 feeds the both pieces of cloth 12 and 13 at each of the sewing pitches to the front side (a direction indicated by arrow A of FIG. 2) in the feeding direction in collaboration with the feed dog.

That is, when the sewing needle 21 penetrates the both pieces of cloth 12 and 13, the presser foot 22 stops the feeding of the both pieces of cloth 12 and 13. In a state where the sewing needle 21 goes upward from the both pieces of cloth 12 and 13, the both pieces of cloth 12 and 13 are fed at each of the sewing pitches by the presser foot 22 and the feed dog.

On the other hand, in the coating apparatus 30, the upper nozzle 32 and the upper stamp part 41 are integrated with the presser foot 22 and are positioned on the front side from the sewing needle 21 in the feeding direction of the pieces of cloth 12 and 13. Above the both pieces of cloth 12 and 13, the upper nozzle 32 and the upper stamp part 41 move to the front side and the rear side in the feeding direction while moving vertically synchronously with the vertical movement of the sewing needle 21. At that time, the upper nozzle 32 drips the upper reinforcing liquid 34 on the cloth 12 from the ea portion of the upper stamp part 41 in the feeding direction. Whenever the sewing needle 21 moves vertically, the dripped upper reinforcing liquid 34 is directly pressed on the upper surface of the cloth 12 by the upper elastic part 44 of the upper stamp part 41, so as to be expanded around the sewn part 14. At that time, the upper elastic part 44 is elastically deformed so that the upper reinforcing liquid 34 is directly pressed on the cloth 12 to be expanded around the sewn part 14.

Herein, it is considered that the brush is used instead of the upper stamp part 41 to coat the sewn part 14 and the peripheral portion thereof with the upper reinforcing liquid 34. However, in a case where the sewing crease is formed at the time of the sewing of the sewing needle 21, and the both pieces of cloth 12 and 13 are waved in the feeding direction, there is a concern that the brush does not reach a valley portion so as not to coat the valley portion although a crest portion can be coated. The upper reinforcement coating film 56 is not formed in a place where the upper reinforcing liquid 34 is not coated, so that the place has strength lower than the formed place. The reinforcement is different in degree in the feeding direction. On the contrary, when the brush makes pressure with an excessive force on the front side from the presser foot 22 in the feeding direction, there is a concern that the presser foot 22 has a difficulty in feeding the both pieces of cloth 12 and 13 properly.

At that point, in this embodiment, the sewn part 14 having the sewing crease is pressed by the upper stamp part 41. The sewing crease is crushed so that the sewn part 14 and the peripheral portion become in a flat state. For this reason, the upper reinforcing liquid 34 is properly expanded in a belt shape in a continuous state without interruption in the feeding direction. In this manner, the sewn part 14 and the peripheral portion where the sewing crease may be generated can be stably coated with the upper reinforcing liquid 34.

Furthermore, the upper reinforcing liquid 34 is expanded by the upper stamp part 41 when the presser foot 22 feeds the both pieces of cloth 12 and 13. For this reason, in the operation of the upper stamp part 41, it is less likely to hinder that the presser foot 22 feeds the both pieces of cloth 12 and 13 or that the sewing needle 21 moves vertically.

In this manner, in the sewing machine 20 in which the presser foot 22 feeds the both pieces of cloth 12 and 13 while moving vertically synchronously with the sewing needle 21, in this embodiment, the upper stamp part 41 is attached to the presser foot 22, and the upper stamp part 41 is operated by using the presser foot 22. For this reason, unlike the conventional coating apparatus, the dedicated mechanism which drives the upper stamp part 41 is not necessarily provided additionally, so that the configuration of the coating apparatus 30 can be simplified.

In this embodiment, the lower surface of the cloth 13 is coated with the lower reinforcing liquid 38 which is stored in the storing part 54 of the lower stamp part 51. That is, the both pieces of cloth 12 and 13 are pressed to the lower elastic part 52 of the lower stamp part 51 by the upper elastic part 44 of the upper stamp part 41 which moves to the front side and the rear side in the feeding direction of the pieces of cloth 12 and 13 while moving vertically. At that time, the lower elastic part 52 is elastically deformed as well as the upper elastic part 44, so that the cloth 13 contacts the lower reinforcing liquid 38 in the storing part 54. Thus, the lower surface of the cloth 13 is coated with the lower reinforcing liquid 38. Furthermore, in the storing part 54, the lower reinforcing liquid 38 is supplied (replenished) from the lower nozzle 36.

The upper elastic part 44 and the lower elastic part 52 are elastically deformed together, so as to suppress that the noise is generated according to the pressing of the upper stamp part 41.

In addition, although the sewing crease is generated in the sewn part 14, the sewing crease is crushed by the upper stamp part 41 to become in a flat state as described above. For this reason, the lower surface of the cloth 13 can be stably coated with the lower reinforcing liquid 38.

When the both pieces of cloth 12 and 13 are fed by the presser foot 22 and the feed dog, the lower reinforcing liquid 38 is applied in a belt shape around the sewn part 14 onto the lower surface of the cloth 13.

As described above, the coated upper reinforcing liquid 34 is heat-cured so as to form the upper reinforcement coating film 56 illustrated in FIG. 4. The lower reinforcing liquid 38 is heat-cured so as to form the lower enforcement coating film 57 illustrated in FIG. 5. A typical hot air heating and a microwave heating are exemplified as a heating unit. However, it is desirable to use an infrared heating which is capable of heating locally because the infrared heating is advantageous to the energy conservation and to the curing synchronous with sewing and coating.

The fibers of the both pieces of cloth 12 and 13, and the upper thread 23 and the lower thread 24 are fixed by the upper reinforcement coating film 56 and the lower reinforcement coating film 57, and the strength of the sewn part 14 and the peripheral portion is improved on both vertical sides. For this reason, it is possible to suppress the enlargement of the misalignment of the sewn part 14 due to the inflation gas.

Incidentally, the coating width of the upper reinforcement coating and the lower reinforcement coating film 57 is desirably set as narrow as possible in the state of including the sewn part 14 under the condition which obtains the effect of reinforcing the sewn part 14.

In this embodiment, following effects can be obtained in addition to the above effect.

Since only the sewn part 14 and the peripheral portion are coated with the upper reinforcing liquid 34 and the lower reinforcing liquid 38, the bulk of the airbag 11 at the time of being folded up can be made small, and the mountability of the airbag 11 can be improved compared to a case where the entire surface is coated.

The upper reinforcing liquid 34 and the lower reinforcing liquid 38 can be applied almost at the same time as the sewing of the airbag 11, and the productivity can be improved compared to a case where the coating is performed in a process separate from the sewing.

Instead of using the lower stamp part 51, it is considered that the cloth 13 is coated by spraying the lower reinforcing liquid 38, so as to form the lower reinforcement coating film 57. However, it is difficult to embed a spray coating apparatus into the sewing machine 20 in which many mechanisms are embedded under the bed part 28 so as to have small space for embedding another apparatus. Even when the spray coating apparatus is embedded, the embedding place is apart from the sewing needle 21. This case has another problem. The airbag 11 has many curved sewn parts 14, and thus there is a concern that the place apart from the sewn part 14 is coated with the lower reinforcing liquid 38 when the spray coating is performed in the place apart from the sewing needle 21. Accordingly, it is not practical to adopt the spray coating apparatus.

In that point, in this embodiment, a portion, which discharges the lower reinforcing liquid 38 in the lower reinforcing liquid supplying part 35 is formed of the hollow lower nozzle 36 forming the needle shape. The lower nozzle 36 is smaller compared to the spray coating apparatus. In addition, the lower stamp part 51 is configured to have the storing part 54 storing the lower reinforcing liquid 38, and can be thin configured in a small size. Small space is required to provide the lower nozzle 36 and the lower stamp part 51. For this reason, the lower nozzle 36 and the lower stamp part 51 can be disposed near the front side from the sewing needle 21 in the feeding direction of the both pieces of cloth 12 and 13.

The same result is also obtained in the upper nozzle 32 in the upper reinforcing liquid supplying part 31. That is, small space is required to provide the hollow upper nozzle 32 forming the needle shape. For this reason, although a surplus space is small near the front side from the sewing needle 21 in the feeding direction of the both pieces of cloth 12 and 13, the upper nozzle 32 can be disposed therein.

The upper nozzle 32, the lower nozzle 36, and the lower stamp part 51 are disposed near the front side of the sewing needle 21 in the feeding direction of the both pieces of cloth 12 and 13. For this reason, the upper reinforcing liquid 34 and the lower reinforcing liquid 38 can be applied immediately after the both pieces of cloth 12 and 13 are sewn by the sewing needle 21. When the upper reinforcing liquid 34 and the lower reinforcing liquid 38 are applied before the both pieces of cloth 12 and 13 are sewn by the sewing needle 21, there is a concern that such adhesion hinders the vertical movement of the sewing needle 21 or the operation of the driving mechanism of the sewing needle 21. However, in this embodiment, such a problem hardly occurs.

The upper nozzle 32 is attached to the upper stamp part 41 such that the exhaust port is positioned under the upper stamp part 41. For this reason, the exhaust port is positioned near the upper side of the both pieces of cloth 12 and 13, so that the upper reinforcing liquid 34 can be dripped on the sewn part 14 or therenear.

Incidentally, the embodiment can be implemented as a modification obtained by modifying as follows.

<Airbag 11>

Three or more pieces of cloth may be used as the sewing target cloth.

A plurality of pieces of cloth may be used in a state where one sheet of basic cloth is folded along a folding line to be overlapped vertically, or may be used in a state where a plurality of pieces of separate basic cloth are overlapped vertically.

Among the plurality of pieces of cloth 12 and 13, the sewn part 14 to be coated with the reinforcing liquid may be formed in the place different from the circumferential edge.

The airbag 11 to be coated by the coating apparatus 30 with the upper reinforcing liquid 34 and the lower reinforcing liquid 38 may have any one of a reversal type and a non-reversal type.

The reversal-type airbag 11 indicates that the sewn part 14 is formed in the circumferential edge of the plurality of pieces of cloth 12 and 13 at the time of manufacturing, and then the both sides of the pieces of cloth 12 and 13 are reversed. The sewn part 14 is configured to be hidden inside the airbag 11. Such a reversal-type airbag 11 is used mainly in the driver seat airbag device (see FIG. 1) and a passenger seat airbag device.

The non-reversal airbag 11 indicates that the sewn part 14 is formed in the circumferential edge at the time of manufacturing, and then the both sides of the pieces of cloth 12 and 13 are not reversed. The sewn part 14 is exposed to the outside of the airbag 11. For example, such a non-reversal airbag 11 is used in a side airbag device.

<Coating Apparatus 30>

The upper nozzle 32 may be attached in the place different from the upper stamp part 41 under the condition of being positioned between the sewing needle 21, and the horizontal wall 43 and the upper elastic part 44 in the upper stamp part 41. In this case, the upper nozzle 32 may be moved vertically, or may not be moved vertically.

The upper reinforcing liquid supplying part 31 may supply the upper reinforcing liquid 34 on the upper cloth 12 in a different manner from dripping.

The upper stamp part 41 may be attached to the presser foot 22 by a fastener different from the bolt and the nut, or an attaching unit different from fastening.

The lower stamp part 51 and the lower reinforcing liquid supplying part 35 may be not provided not to coat the cloth 13 with the lower reinforcing liquid 38.

Also in this case, the effect of reinforcing the sewn part 14 is obtained although being less effective compared to a case where the both sides of the pieces of cloth 12 and 13 are coated with the reinforcing liquid.

The lower stamp part 51 may include the lower elastic part 52 and a hard member disposed on the lower side thereof. In this case, one of the upper elastic part 44 and the lower elastic part 52 may not be provided under the condition that the lower stamp part 51 is disposed under the upper stamp part 41. Also in this case, the provided one of the upper elastic part 44 and the lower elastic part 52 is elastically deformed such that the upper reinforcing liquid 34 can be expanded on the upper cloth 12, and the lower surface of the cloth 13 can be coated with the lower reinforcing liquid 38.

An effect is also obtained which suppresses that the noise is generated according to the pressing of the upper stamp part 41.

The lower stamp part 51 may be disposed in a place different from the lower side of the upper stamp part 41. Also in this case, the lower reinforcing liquid 38 stored in the storing part 54 can be brought into contact with the lower surface of the cloth 13, so that the lower surface is coated.

The configuration of the storing part 54 in the lower stamp part 51 may be modified differently from the embodiment. For example, the storing part 54 may be formed of a plurality of grooves which extend in the feeding direction of the both pieces of cloth 12 and 13, and of which adjacent ones communicate with each other.

In addition to the storing part 54, the lower stamp part 51 may be modified to have another member which does not directly relate to the storing of the lower reinforcing liquid 38. In this case, a portion corresponding to the lower stamp part 51 may be made of an elastic material, or may be made of a hard material.

According to an aspect of the invention, there is provided a coating apparatus of an airbag reinforcing liquid, which is used in a sewing machine that includes: a sewing needle which is configured to drive an upper thread by penetrating sewing target cloth through a vertical movement, a plurality of pieces of airbag forming cloth vertically overlapped with each other being set as the sewing target cloth; and a presser foot which is disposed above the sewing target cloth, and which is configured to feed the sewing target cloth while moving vertically synchronously with the vertical movement of the sewing needle, the coating apparatus including: a reinforcing liquid supplying part which is configured to supply a reinforcing liquid for reinforcing a sewn part formed by the sewing needle onto the sewing target cloth on a front side from the sewing needle in a feeding direction of the sewing target cloth; and a stamp part which is attached to the presser foot, and which is configured to expand the reinforcing liquid supplied from the reinforcing liquid supplying part onto the sewing target cloth around the sewn part by being operated integrally with the presser foot above the sewing target cloth.

With such a configuration, the plurality of pieces of airbag forming cloth vertically overlapped with each other are set to the sewing target cloth of the sewing machine. The sewing needle of the sewing machine moves vertically such that the sewing needle penetrates the sewing target cloth, and thus the upper thread is driven into the sewing target cloth. In addition, the presser foot which is disposed above the sewing target cloth feeds the sewing target cloth while moving vertically synchronously with the vertical movement of the sewing needle.

On the other hand, in the coating apparatus, the reinforcing liquid is supplied from the reinforcing liquid supplying part onto the sewing target cloth on the front side of the sewing needle in the feeding direction of the sewing target cloth. In addition, the stamp part moves to the front side and the rear side in the feeding direction of the sewing target cloth above the sewing target cloth integrally with the presser foot while moving vertically synchronously with the vertical movement of the sewing needle. With the stamp part, the reinforcing liquid which is supplied from the reinforcing liquid supplying part onto the sewing target cloth is expanded around the sewn part whenever the sewing needle moves vertically.

In this manner, in the sewing machine in which the presser foot feeds the sewing target cloth while moving vertically synchronously with the sewing needle, the stamp part is attached to the presser foot, so that the stamp part is operated. For this reason, the dedicated mechanism which drives the stamp part is not necessarily provided additionally, so that the configuration of the coating apparatus can be simplified.

In the coating apparatus, the reinforcing liquid supplying part may include an upper reinforcing liquid supplying part which is configured to supply an upper reinforcing liquid, which is at least a part of the reinforcing liquid, onto the sewing target cloth through an upper nozzle disposed above the sewing target cloth.

With such a configuration, in the coating apparatus, on the front side from the sewing needle in the feeding direction of the sewing target cloth, the upper reinforcing liquid is dripped from the upper nozzle disposed above the sewing target cloth on the sewing target cloth as at least a part of the reinforcing liquid. The dripped upper reinforcing liquid is expanded around the sewn part by being directly pressed on the upper surface of the sewing target cloth by the stamp part operated above the sewing target cloth whenever the sewing needle moves vertically.

In the coating apparatus, the stamp part may be an upper stamp part disposed above the sewing target cloth, the coating apparatus may further include: a lower stamp part which is disposed below the sewing target cloth, and which includes a storing part that is configured to store a lower reinforcing liquid for coating a lower surface of the sewing target cloth, which is a part of the reinforcing liquid, and the reinforcing liquid supplying part may further include a lower reinforcing liquid supplying part which is configured to supply the lower reinforcing liquid to the storing part.

With such a configuration, the upper reinforcing liquid which is dripped on the sewing target cloth from the upper nozzle of the upper reinforcing liquid supplying part is expanded by the upper stamp part, and further the lower surface of the sewing target cloth is coated with the lower reinforcing liquid which is supplied from the lower reinforcing liquid supplying part and is stored in the storing part of the lower stamp part. The sewing target cloth is fed by the presser foot, so that the lower reinforcing liquid is applied around the sewn part in a belt shape.

According to an aspect of the invention, there is provided a coating apparatus of an airbag reinforcing liquid, which is used in a sewing machine that includes: a sewing needle which is configured to drive an upper thread by penetrating a sewing target cloth through a vertical movement, a plurality of pieces of airbag forming cloth vertically overlapped with each other being set as the sewing target cloth; and a presser foot which is disposed above the sewing target cloth, and which is configured to feed the sewing target cloth while moving vertically synchronously with the vertical movement of the sewing needle, the coating apparatus including: an upper reinforcing liquid supplying part which is configured to drip an upper reinforcing liquid for reinforcing a sewn part formed by the sewing needle from an upper nozzle disposed above the sewing target cloth on a front side from the sewing needle in a feeding direction of the sewing target cloth; an upper stamp part which is attached to the presser foot, and which is configured to expand the upper reinforcing liquid dripped from the upper nozzle on the sewing target cloth around the sewn part by being operated integrally with the presser foot above the sewing target cloth; a lower stamp part which is disposed below the sewing target cloth, and which includes a storing part that is configured to store a lower reinforcing liquid for coating a lower surface of the sewing target cloth to reinforce the sewn part; and a lower reinforcing liquid supplying part which is configured to supply the lower reinforcing liquid to the storing part.

With such a configuration, in the coating apparatus, the upper stamp part attached to the presser foot is integrated with the presser foot, and moves to the front side and the rear side in the feeding direction of the sewing target cloth above the sewing target cloth while moving vertically synchronously with the vertical movement of the sewing needle.

On the other hand, on the front side from the sewing needle in the feeding direction, the upper reinforcing liquid is dripped on the sewing target cloth from the upper nozzle disposed above the sewing target cloth. The dripped upper reinforcing liquid is directly pressed on the upper surface of the sewing target cloth by the upper stamp part whenever the sewing needle moves vertically, and is expanded around the sewn part.

In this manner, in the sewing machine in which the presser foot feeds the sewing target cloth while moving vertically synchronously with the sewing needle, the upper stamp part is attached to the presser foot, so that the upper stamp part is operated. For this reason, the dedicated mechanism which drives the upper stamp part is not necessarily provided additionally, so that the configuration of the coating apparatus can be simplified.

The lower surface of the sewing target cloth is coated with the lower reinforcing liquid which is supplied from the lower reinforcing liquid supplying part and is stored in the storing part of the lower stamp part. The sewing target cloth is fed by the presser foot, so that the lower reinforcing liquid is applied around the sewn part in a belt shape.

In the coating apparatus, the lower stamp part may be disposed under the upper stamp part.

With such a configuration, the sewing target cloth is pressed to the lower stamp part by the upper stamp part that moves to the front side and the rear side in the feeding direction of the sewing target cloth while moving vertically. For this reason, the sewing target cloth is brought in contact with the lower reinforcing liquid stored in the storing part of the lower stamp part, and the lower surface of the sewing target cloth is coated with the lower reinforcing liquid.

In the coating apparatus, at least the storing part in the lower stamp part may include a lower elastic part made of an elastic material.

With such a configuration, when the sewing target cloth is pressed to the lower stamp part by the upper stamp part, the lower elastic part is elastically deformed so that the sewing target cloth is brought in contact with the lower reinforcing liquid stored in the storing part of the lower stamp part, and it is suppressed that the noise due to the pressing is generated.

In the coating apparatus, at least a part of the upper stamp part may include an upper elastic part made of an elastic material by which the upper reinforcing liquid is expanded.

With such a configuration, the upper stamp part presses the sewing target cloth to the lower stamp part with the upper elastic part. At that time, the upper elastic part is elastically deformed so that the upper reinforcing liquid is directly pressed on the upper surface of the sewing target cloth to be expanded around the sewn part. In addition, the upper elastic part is elastically deformed as well as the lower elastic part so that it is further suppressed that the noise due to the pressing of the upper stamp part is generated.

In the coating apparatus, the upper nozzle may be attached in a rear portion of the upper stamp part in the feeding direction of the sewing target cloth.

With such a configuration, the upper nozzle moves to the front side and the rear side in the feeding direction of the sewing target cloth together with the upper stamp part integrally with the presser foot above the sewing target cloth while moving vertically synchronously with the vertical movement of the sewing needle. At that time, the upper nozzle drips the upper reinforcing liquid on the rear portion of the upper stamp part in the feeding direction. The upper reinforcing liquid is expanded by the upper stamp part immediately after the dripping.

With the coating apparatus of the airbag reinforcing liquid, it is possible to coat the sewn part and the peripheral portion with the reinforcing liquid with the simple configuration.

What is claimed is:

1. A coating apparatus for an airbag reinforcing liquid, which is used in a sewing machine that includes: a sewing needle that is configured to drive an upper thread by penetrating sewing target cloth through a vertical movement, a plurality of pieces of airbag forming cloth vertically overlapped with each other being set as the sewing target cloth; and a presser foot that is disposed above the sewing target cloth, and that is configured to feed the sewing target cloth while moving vertically synchronously with the vertical movement of the sewing needle, the coating apparatus comprising:

a reinforcing liquid supplying part configured to supply a reinforcing liquid for reinforcing a sewn part formed by the sewing needle onto the sewing target cloth on a front side from the sewing needle in a feeding direction of the sewing target cloth; and a stamp part attached to the presser foot, the stamp part includes a flat surface that extends in the feeding direction of the sewing target cloth, and the stamp part is configured to expand the reinforcing liquid supplied from the reinforcing liquid supplying part onto the sewing target cloth around the sewn part by being operated integrally with the presser foot above the sewing target cloth.

2. The coating apparatus according to claim 1, wherein the reinforcing liquid supplying part includes an upper reinforcing liquid supplying part that is configured to supply an upper reinforcing liquid, that is at least a part of the reinforcing liquid, onto the sewing target cloth through an upper nozzle disposed above the sewing target cloth.

3. The coating apparatus according to claim 2, wherein the stamp part is an upper stamp part disposed above the sewing target cloth, the coating apparatus further comprising:

a lower stamp part that is disposed below the sewing target cloth, and that includes a storing part that is configured to store a lower reinforcing liquid for coating a lower surface of the sewing target cloth, that is a part of the reinforcing liquid, wherein the reinforcing liquid supplying part further includes a lower reinforcing liquid supplying part that is configured to supply the lower reinforcing liquid to the storing part.

4. The coating apparatus according to claim 3, wherein the lower stamp part is disposed under the upper stamp part.

5. The coating apparatus according to claim 4, wherein at least the storing part in the lower stamp part includes a lower elastic part made of an elastic material.

6. The coating apparatus according to claim 5, wherein at least a part of the upper stamp part includes an upper elastic part made of an elastic material by that the upper reinforcing liquid is expanded.

7. The coating apparatus according to claim 3, wherein the upper nozzle is attached in a rear portion of the upper stamp part in the feeding direction of the sewing target cloth.

8. The coating apparatus according to claim 3, wherein the storing part extends in the feeding direction of the sewing target cloth.

9. The coating apparatus according to claim 1, wherein the stamp part includes a vertical wall, a horizontal wall attached perpendicular to the vertical wall, and an elastic part that is made of an elastic material and attached to a bottom surface of the vertical wall, and the flat surface is a flat contact surface formed on a bottom of the elastic part.

10. The coating apparatus according to claim 9, wherein an attachment hole is formed in a boundary between the horizontal wall and the vertical wall and extends from a top surface of the vertical wall to the bottom surface of the vertical wall.

11. A coating apparatus for an airbag reinforcing liquid, that is used in a sewing machine that includes: a sewing needle that is configured to drive an upper thread by penetrating a sewing target cloth through a vertical movement, a plurality of pieces of airbag forming cloth vertically overlapped with each other being set as the sewing target cloth; and a presser foot that is disposed above the sewing target cloth, and that is configured to feed the sewing target cloth while moving vertically synchronously with the vertical movement of the sewing needle, the coating apparatus comprising:

an upper reinforcing liquid supplying part configured to drip an upper reinforcing liquid for reinforcing a sewn part formed by the sewing needle from an upper nozzle disposed above the sewing target cloth on a front side from the sewing needle in a feeding direction of the sewing target cloth;

an upper stamp part attached to the presser foot, the upper stamp part includes a flat surface that extends in the feeding direction of the sewing target cloth, and the upper stamp part is configured to expand the upper reinforcing liquid dripped from the upper nozzle on the sewing target cloth around the sewn part by being operated integrally with the presser foot above the sewing target cloth;

a lower stamp part disposed below the sewing target cloth, the lower stamp part includes a flat surface that extends in the feeding direction of the sewing target cloth, and the lower stamp part includes a storing part configured to store a lower reinforcing liquid for coating a lower surface of the sewing target cloth to reinforce the sewn part; and a lower reinforcing liquid supplying part configured to supply the lower reinforcing liquid to the storing part.

12. The coating apparatus according to claim 11, wherein the upper nozzle is attached in a rear portion of the upper stamp part in the feeding direction of the sewing target cloth.

13. The coating apparatus according to claim 11, wherein the storing part extends in the feeding direction of the sewing target cloth.

14. The coating apparatus according to claim 11, wherein the storing part includes a plurality of storing parts and a communicating passage that communicates the plurality of the storing parts with each other.

15. The coating apparatus according to claim 14, further comprising a lower nozzle that penetrates at least one of the plurality of storing parts of the lower stamp part.

* * * * *